US007445255B2

(12) United States Patent
Nye-Hingston et al.

(10) Patent No.: US 7,445,255 B2
(45) Date of Patent: Nov. 4, 2008

(54) CABINET LOCK

(75) Inventors: Matthew Richard Alex Nye-Hingston, Auckland (NZ); Neil Richard Hingston, Auckland (NZ)

(73) Assignee: Magna Limited, Auckland (NZ)

( * ) Notice: Subject to any disclaimer, the term of this patent is extended or adjusted under 35 U.S.C. 154(b) by 120 days.

(21) Appl. No.: 10/576,290

(22) PCT Filed: Oct. 15, 2004

(86) PCT No.: PCT/NZ2004/000253

§ 371 (c)(1),
(2), (4) Date: Jul. 17, 2006

(87) PCT Pub. No.: WO2005/035918

PCT Pub. Date: Apr. 21, 2005

(65) Prior Publication Data

US 2007/0085348 A1 Apr. 19, 2007

(30) Foreign Application Priority Data

Oct. 17, 2003 (NZ) ..... 528984

(51) Int. Cl.
*E05C 1/06* (2006.01)

(52) U.S. Cl. ..... 292/144; 292/341.14; 312/215

(58) Field of Classification Search ..... 292/201, 292/144, 300, 341.14, 302; 312/215
See application file for complete search history.

(56) References Cited

U.S. PATENT DOCUMENTS 1,097,154 A * 5/1914 Wright ..... 70/441
5,096,241 A * 3/1992 Badger ..... 292/288
6,068,305 A * 5/2000 Myers et al. ..... 292/201
6,082,790 A * 7/2000 Mossotti et al. ..... 292/341.14
7,048,312 B2 * 5/2006 Brunner ..... 292/163
7,073,827 B2 * 7/2006 Cherry ..... 292/201
7,113,071 B2 * 9/2006 Cayne et al. ..... 340/5.22
7,246,827 B2 * 7/2007 Geringer et al. ..... 292/144

FOREIGN PATENT DOCUMENTS

| | | |
|---|---|---|
| FR | 2667646 | 4/1992 |
| FR | 2755458 | 5/1998 |
| GB | 2223058 | 3/1990 |
| WO | WO97/02399 | 1/1997 |

* cited by examiner

*Primary Examiner*—Gary Estremsky
(74) *Attorney, Agent, or Firm*—Jacobson Holman PLLC

(57) ABSTRACT

A cabinet lock for selectively locking a cabinet of a kind including a compartment structure and a closure movable relative to the compartment structure for selectively closing an opening of the compartment structure. The cabinet lock including a latch bolt assembly including a mounting and a bolt movably disposed with the mounting between a locking position and an unlocked position. Also provided is a striker including a coupling region with which the bolt can couple to thereby isolate relative movement between the latch bolt and the striker in at least one direction lateral to the direction of movement of the bolt between its locking position and the unlocked position. The striker is engagable with the compartment structure and the latch bolt is engagable with the closure in a manner to place such in coupling proximity when the closure is in closing relation with the opening of the compartment structure.

41 Claims, 4 Drawing Sheets

1
2
3
5
6
7
8
9
12
X

CABINET LOCK

This is a nationalization of PCT/NZ04/000253 filed Oct. 15, 2004 and published in English.

FIELD OF THE INVENTION

The present invention relates to a cabinet lock and a cabinet including such a lock which in particular although not solely is provided for the purposes of providing a safety locking system for preventing children or other undesired access to the interior of a cabinet.

BACKGROUND OF THE INVENTION

Access to certain goods or property often needs to be limited or controlled. For example in a domestic situation cleaning products or other chemicals are often stored in kitchen cabinets. Where children or toddlers are able to reach such locations it becomes essential for access to the storage regions of the cabinets to be controlled and in most situations to be secured so as to prevent a toddler from gaining access to such locations. However some such kitchen cabinets are in frequent use by adults and it is not desirable for the manner in which access is restricted to the cabinets to be cumbersome or difficult to achieve. It is however desirable for any mechanism to lock the cabinets to be provided internal of the cabinets.

It normally does not take long for a toddler to figure out how an external locking arrangement may be rendered ineffective and it is hence desirable for any locking mechanism to be provided internally of the cabinet and hence out of sight of any enterprising toddler. An issue which will arise by having a locking mechanism mounted internally is that access to such may then also be difficult to obtain by an adult who does wish to have access to the interior of the cabinet. Electric latching devices actuated from external of a cabinet such as that disclosed for example in WO97/02399 can be utilized for such purposes. It is however desirable to operate any electric mechanisms in a manner where minimal power is consumed. Since in most circumstances the cabinet doors or drawers will be in a closed condition, in such a default condition it would be undesirable for continuous power to be drawn by a locking unit. In addition however it may be desirable that the locking arrangement is made redundant and that free and unfettered access to the cabinet can be achieved. Such may be desirable for a significant duration of time and it would be undesirable for the locking device to, during such periods of time, be drawing power from a power source in order to achieve such an unlocked position. It is accordingly desirable to be able to isolate the locking device in a condition where it does not provide a restriction to the opening of a cabinet yet still not draw a significant amount of power from the power source when operated in such a condition. Indeed where a single power source may provide power to several locking devices for different cabinet doors or drawers it may be desirable that for a significant duration of time, one or more of the locking units is in such a condition where it does provide operative locking to the door or door with which it is associated.

Accordingly it is an object of the present invention to provide a cabinet lock which addresses the abovementioned desiderata or which will at least provide the public with a useful choice.

BRIEF DESCRIPTION OF THE INVENTION

Accordingly in a first aspect the present invention consists in a cabinet lock for selectively locking a cabinet of a kind comprising a compartment structure and a closure movable relative to said compartment structure for selectively closing an opening of said compartment structure, said cabinet lock comprising:

a latch bolt assembly including a mounting and a bolt movably disposed with said mounting between a locking position and an unlocked position, a striker including a coupling region with which said bolt can couple to thereby isolate relative movement between said latch bolt and said striker in at least one direction lateral to the direction of movement of said bolt between its locking position and said unlocked position, wherein said striker is engagable with one of said compartment structure and closure and said latch bolt is engagable with the other of said compartment structure and closure in a manner to place such in coupling proximity when said closure is in closing relation with said opening of said compartment structure, said latch bolt including means to urge or is positioned to urge said bolt to said locking position, and said striker including an interference means movable to interfere with the movement of said bolt into coupling engagement with said coupling region of said striker to thereby prevent coupling.

Preferably said bolt moves in a linear manner relative to said mounting between its locking position and an unlocked position.

Preferably said striker includes an aperture, said coupling of said bolt and said striker occurring by a penetrative engagement of said bolt with said aperture thereby isolating relative movement between said latch bolt and said striker in at least one direction lateral to the direction of penetration of said bolt.

Preferably said striker is in use fixed to one of (a) said compartment structure and (b) closure, and said latch bolt is in use fixed with the other of said compartment structure and closure.

Preferably said striker includes a portion fixed to one of said compartment structure and closure and said interference means is in sliding engagement with the portion fixed.

Alternatively said striker includes a portion fixed to one of said compartment structure and closure and said interference means is in rotational engagement with the portion fixed.

Preferably said interference means in manually movable.

Preferably said interference means is a cover to at least in part extend across the opening of said aperture of said striker to present interference to the movement of said bolt into said aperture.

Preferably said interference means is a tongue which is capable of extending at least in part across said aperture.

Alternatively said interference means is a means movable relative to the fixed portion of said striker the interference means itself carrying and/or defining the aperture, the movement of the interference means relative to the apportion fixed of the striker moving the aperture into and out of alignment for penetrative engagement by said bolt.

Preferably said means to urge is an electromagnetic means actuable to displace said bolt from said unlocked position to said locking position.

Preferably said electromagnet means is actuable to displace said bolt from said locked position to said unlocked position.

Preferably means to control actuation of said electromagnetic means is provided, remote from said latch bolt.

Alternatively said means to urge is a passive biasing means (e.g. a spring).

Preferably said means to urge is a passive biasing means (e.g. a spring) and an electromagnetic means is provided to move said bolt from said locking position to said unlocked position.

Preferably said bolt is in its natural state biased toward said locking position.

Preferably said striker includes a ramp surface over which said bolt can slide during movement of said closure to a condition closing the opening of said compartment to displace said bolt towards is unlocked position.

Preferably said ramp leads to a plateau surface of said striker at which the opening to said aperture is provided.

Preferably said electromagnetic means is powered from remote power source.

Preferably said electromagnet means is controlled for actuation by a remote switch.

Preferably said remote switch controls the delivery of power from said power source to said electromagnetic means.

Preferably said remote switch is hard wired with said electromagnetic means.

Preferably said electromagnetic means is a solenoid.

Preferably said electromagnetic means includes the bolt which is of a ferrous material and extending into and/or through a coil capable of being powered by said power source.

Preferably said remote switch is a reed switch actuable by influence of a magnetic field.

Preferably said magnetic field is provided by a key which includes a permanent magnet.

Preferably latch bolt includes an electromagnetically movable bolt, said latch bolt including a first electric connection terminal for the engagement of an electric lead for delivery of electromagnetic power to said latch bolt and a second electric connection terminal in electrical connection with said first and capable of receiving an electric lead for the delivery of said power from said latch bolt to an other like latch bolt.

Preferably each cabinet lock includes its said bolt disposed from said mount in a manner normally biased towards said locking position (eg by a spring) save for upon the actuation of said electromagnetic means to move said bolt to the unlocked position.

Preferably each said cabinet lock includes it own designated means to actuate (e.g. reed switch) said electromagnetic means and independent of the others.

In a further aspect the present invention consists in a cabinet which includes a compartment defining structure including an opening closable by a closure means (eg a door or drawer) movable relative to said compartment structure, said cabinet further including a cabinet lock for selectively locking said closure means and said compartment defining structure when in a condition closing said compartment defining structure, said cabinet lock comprising:

a latch bolt assembly including a mounting and a bolt movably disposed with said mounting between a locking position and an unlocked position, a striker including a coupling region with which said bolt can couple to thereby isolate relative movement between said latch bolt and said striker in at least one direction lateral to the direction of movement of said bolt between its locking position and said unlocked position, said striker is fixed to one of said compartment structure and closure and said latch bolt is fixed to the other of said compartment structure and closure in a manner to place such in coupling proximity when said closure is in closing relation with said opening of said compartment structure, said latch bolt including means to urge or is positioned to urge said bolt to said locking position, and said striker including an interference means movable to interfere with the movement of said bolt into coupling engagement with said coupling region of said striker to thereby prevent coupling.

Preferably said cabinet includes a plurality of openings closable by independently movable closure means, each closure means having in association a said cabinet lock.

Preferably each said cabinet lock includes its said bolt disposed from said mount in a manner normally biased towards said locking position (e.g. by a spring) save for upon the actuation of an electromagnetic means of said mounting to move said bolt to the unlocked position.

Preferably each said cabinet lock includes it own designated means to actuate said electromagnetic means and independent of the others.

Preferably said means to actuate is a switch.

Preferably each said electromagnetic means is powered from one power source.

Preferably said latch bolt and striker are positioned internal of the compartment structure and said switch is actuable from external of the compartment structure.

Preferably the switch is a magnetically actuable switch (e.g. a reed switch).

Preferably said reed switch is placed external of said compartment structure.

Alternatively said reed switch is positioned internal of the compartment structure but is positioned to be influenced by a magnetic field the source of which is or may be placed external of the compartment structure.

In a further aspect the present invention consists in a cabinet which includes a compartment defining structure including an opening closable by a closure means (e.g. a door or drawer) movable relative to said compartment defining structure, said cabinet further including a cabinet lock for selectively locking said closure means and said compartment defining structure when in a condition closing said compartment defining structure, said cabinet lock being of a kind as herein before described.

Preferably said mounting includes apertures for mechanically fastening said latch bolt to one of said compartment structure and closure.

Preferably said striker includes apertures for mechanically fastening said latch bolt to the other of said compartment structure and closure.

Preferably said mounting is in use fixed to said compartment structure.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

A preferred form of the invention will now be described with reference to the accompanying drawings in which.

DETAILED DESCRIPTION OF THE INVENTION

Figures 1A, 1B:
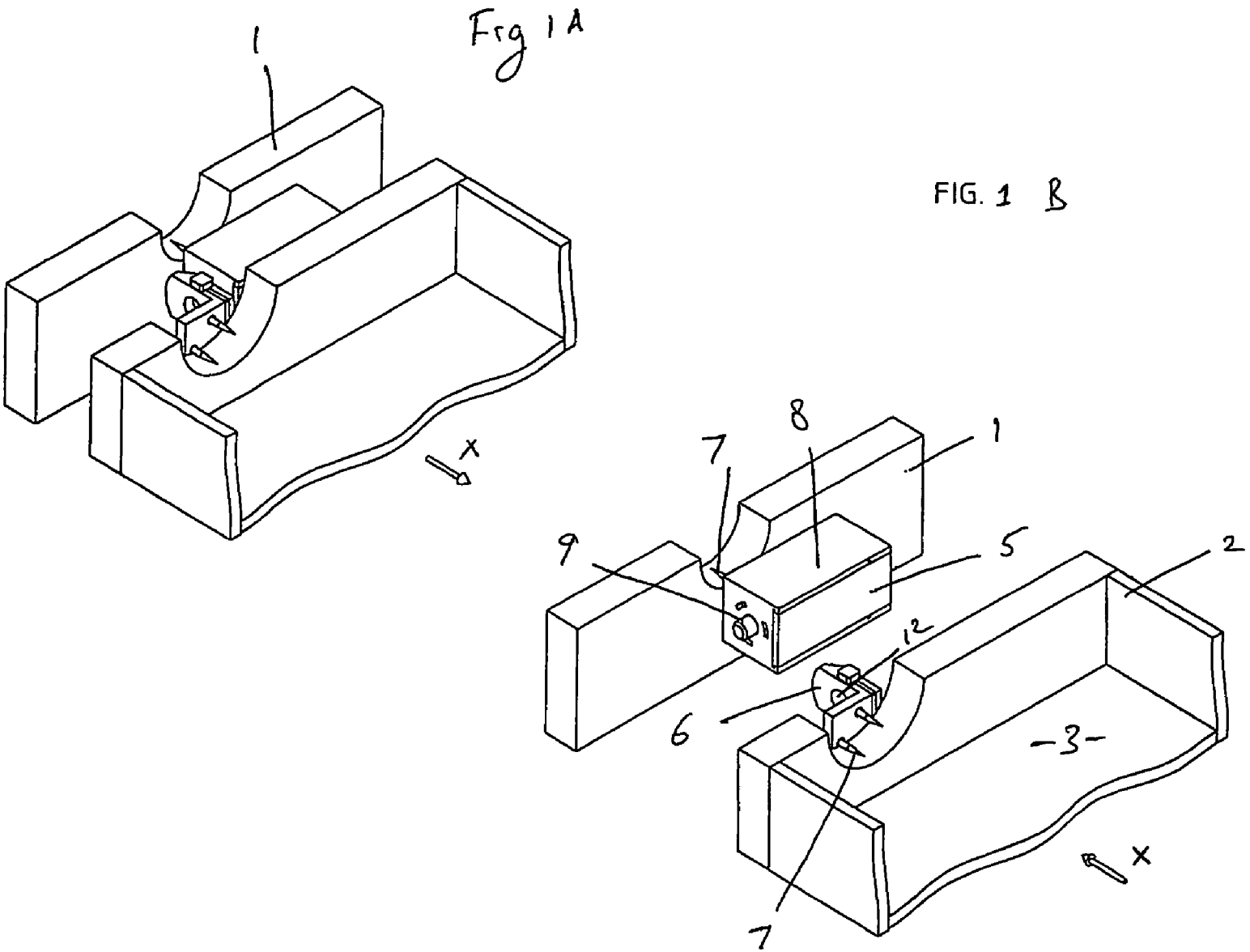
FIG. 1A is a perspective view of part of a cabinet including part of the compartment structure with which the latch bolt assembly is engaged and part of a drawer with which the striker is engaged showing the latch bolt assembly and the striker in a position for locking together.
FIG. 1B is a perspective view of the configuration of FIG. 1A but wherein the drawer has been moved relative to the compartment structure and is in an unlocked and disengaged condition.
Figures 2A, 2B:
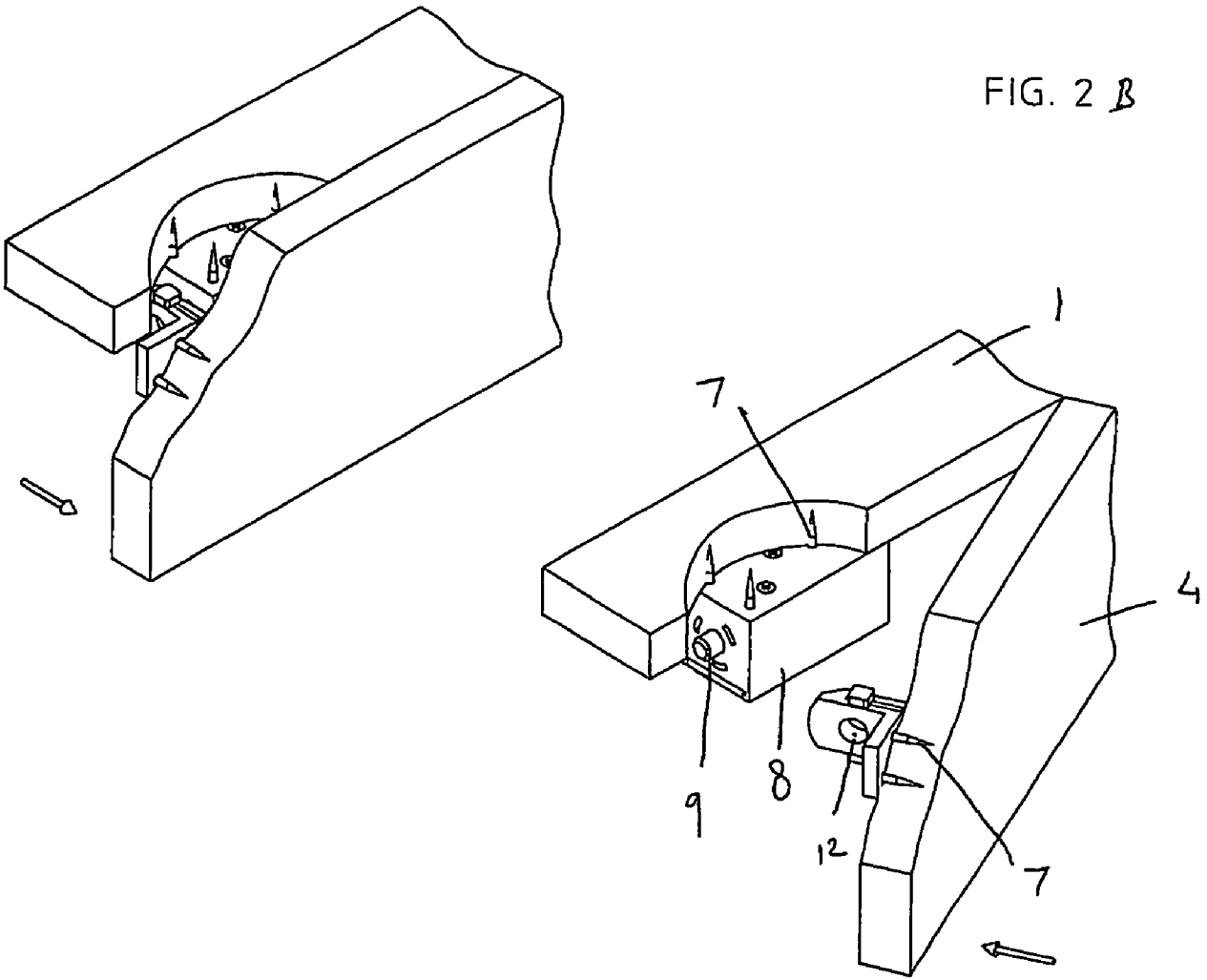
FIG. 2A is a perspective view of a cabinet wherein the closure is a cabinet door rather than a drawer as shown in FIGS. 1A and 1B and wherein the door is in a locked position with the compartment structure of the cabinet.
FIG. 2B is a perspective view of FIG. 2A wherein the cabinet door is in an unlocked and partially opened condition relative to the compartment structure of the cabinet.

With reference to FIG. 1B there is shown part of a cabinet which includes a compartment structure 1 and a drawer 2 which is movable relative to the compartment structure in a linear fashion and for example in direction X relative to the compartment structure 1. The compartment structure 1 may include a back wall of the compartment with which part of the cabinet lock is engaged. The drawer 2 can extend and be drawn from the compartment structure 1 to expose the drawer containment region 3 to the exterior of the compartment structure 1. In an alternative application the cabinet lock of the present invention may be utilized where a door 4 is pivotally movable relative to the compartment structure 1 which with reference to FIG. 2B may for example be a shelf or top wall member of the fixed compartment structure. The door 4 will be pivotally dependent to the compartment structure so as to be able to open and close an opening to the compartment structure to thereby allow and prevent access to the interior of the compartment via such an opening. The cabinet lock of the present invention consists of a latch bolt structure 5 and a striker 6. One or the other of the latch bolt structure 5 or striker 6 is engaged to the compartment structure 1 or to the closure device such as the drawer 2 or door 4. In the most preferred form and as shown in the drawings the latch bolt assembly 5 is engaged to the compartment structure 1 and the striker is engaged to the drawer or door 2, 4. The latch bolt assembly 5 is preferably engaged to the compartment structure 1 by means of fasteners 7 such as screws. Likewise the striker is engaged to the drawer or door by fastening elements such as screws 7. Some of the screws 7 have been revealed by the partially cutaway view of the portions of the cabinet at where such are affixed. Alternative means of fastening can be provided such as for example by way of adhesive, bolts or by other mechanical means.

The striker 6 is provided in a location with the drawer or door 2, 4 such that when the drawer or door is positioned relative to the compartment structure 1 to close the opening to the cabinet, the striker is in a proximity to the latch bolt assembly 5 to allow for them to become engaged with each other. The latch bolt assembly 5 preferably includes a mounting 8 which carries therewith a bolt 9. The bolt 9 is movable relative to the mounting 8 and hence also to the compartment structure 1 between a condition locking and a condition unlocked. Such a movement is preferably a linear movement. In the most preferred form movement at least from a direction locked to the direction unlocked is actuated by an electromagnetic configuration of the latch bolt assembly 5. Movement of the bolt 9 from the unlocked position to the locked position may be achieved by a biasing element such as a spring within the mounting 8 which urges the bolt 9 from the unlocked position to the locked position. With reference to FIG. 1B the locked position is a position where the bolt 9 protrudes from or to a greater extent from the mounting 8 than in the unlocked position. In the unlocked position the bolt 9 may be retracted within the housing of the mounting 8 or may protrude therefrom to a lesser extent.

Figure 4:
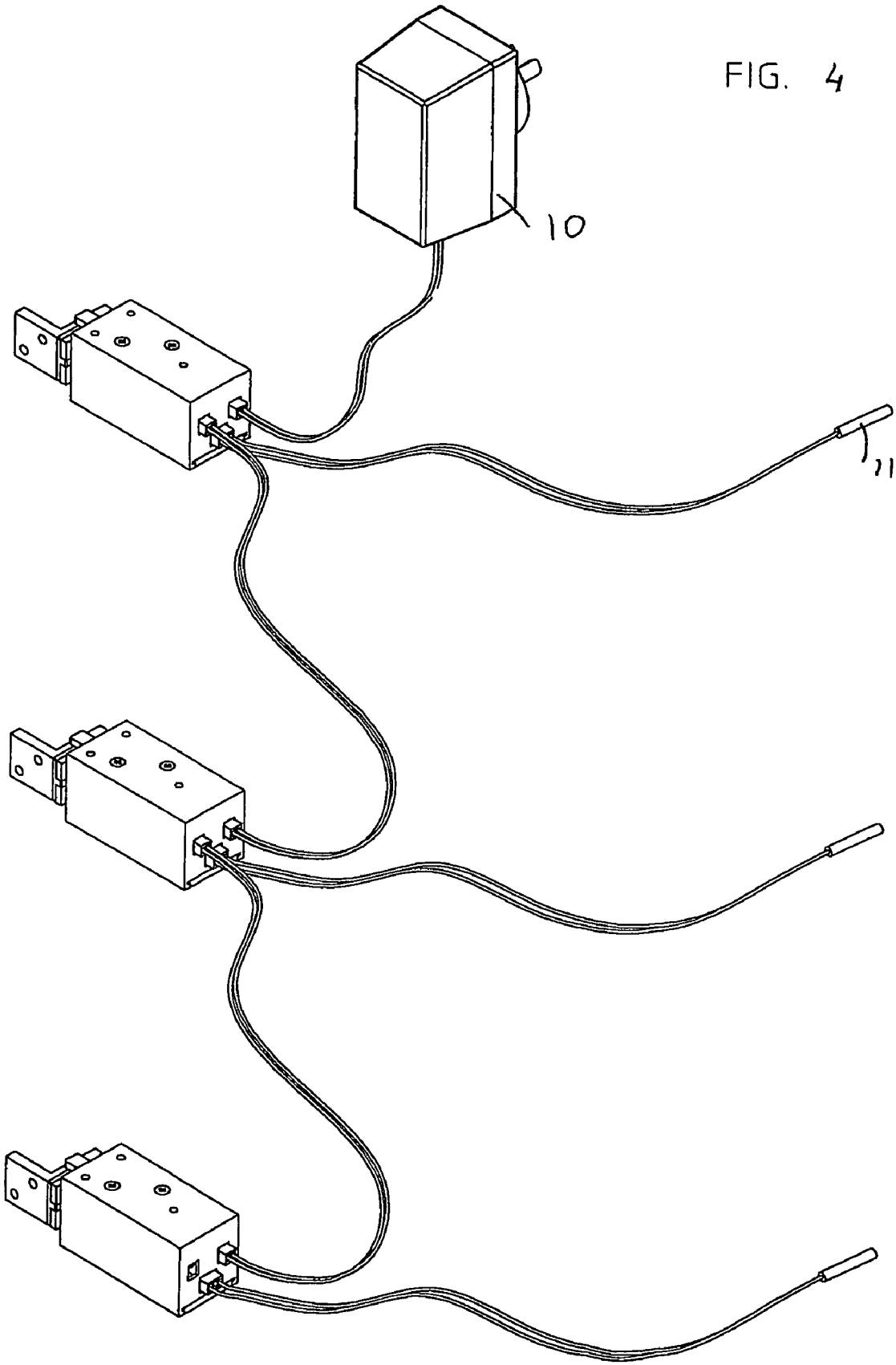
FIG. 4 is a perspective view of a plurality of cabinet locks the striker bolt assemblies of which are in a chained relationship relative to each other and relative to a power source and wherein each includes its own designated switch for individual actuation.

The latch bolt assembly is preferably engaged via wiring as for example shown in FIG. 4 to a power source 10. The power source 10 may be a transformer deriving power from mains electricity. Power is drawn from the power source by the cabinet lock of the present invention preferably only during the movement of the bolt 9 from the locking position to the unlocking position. A coil within the mounting 8 may be energized upon the actuation of a switch 11 which controls the delivery of power from the power source 10 to the coil within the mounting 8. With the use of a ferrous bolt 9 extending through the coil (not shown) of the mounting 8 and upon its energization the bolt 9 can be drawn from the locked position as shown in FIG. 1B to an unlocked position. Once the delivery of power to the cabinet lock is terminated the bolt is again urged towards the locked position. In the locked position, the bolt 9 engages with the striker 6 in a manner to become engaged therewith. Such engagement is to prevent the movement of the latch at least in a direction lateral to the direction of movement of the bolt 9 between its locked and unlocked positions. Accordingly in the most preferred form the striker presents an aperture 12 which may be a through hole or a blind hole in the striker plate of the striker 6 and into which the bolt 9 can penetrate. Such penetration and when in the locked position of the bolt 9 will prevent the striker 6 from moving a direction lateral to the penetrative direction and thereby accordingly will prevent the cabinet drawer or door from opening. It will be appreciated that whilst in the most preferred form it is an aperture 12 which provides a surface against which the bolt will engage to prevent the cabinet door or drawer from opening, it may alternatively be a rebate, recess, upstand, blind hole or any other region of the striker which presents a surface to present interference to the movement of the striker in the direction lateral to the penetrative direction of the bolt 9.

In the most preferred mode of operation the bolt 9 and in its natural condition is biased towards a locking position as shown in FIG. 1B where the bolt extends furthermore from the mounting 8 than in the unlocked position. Electromagnetic actuation is employed to move the bolt from the locked position to an unlocked position.

In normal use, a kitchen cabinet remains predominantly closed. In such a condition it is desirable for the cabinet doors or drawers to remain locked and be prevented from opening in order to ensure that minimal power usage occurs. To achieve this, the bolt 9 is preferably urged towards the locked position by means of a spring (not shown) which provides a bias to the bolt in and towards the locked position. The bolt in such a position is naturally biased towards the locked position however can be pressed back into the mounting 8 as and when desired. As such, no electromagnetic forces are pushing the bolt towards the locked position and it is merely the forces of a spring or gravity which hold the bolt in or towards the locked position. Hence no or minimal power consumption occurs.

Alternatively the bolt, if the housing is affixed to the cabinet structure in a vertically extending direction, may rely on gravity to bias it towards the locked position which would be in a downward direction. When it is desired for the cabinet to be unlocked and to allow for the drawer or doors to be opened electromagnetic actuation can be triggered to move the bolt from the locked position to the unlocked position. This will then retract the bolt from the aperture 12 and allow for the door or drawer to be opened. When the striker is displaced from the latch bolt, electromagnetic actuation may be terminated and the bolt may return to a locked position however such will then not be in engagement with the striker.

In moving the cabinet drawer or door back to a closed condition (closing the opening of the cabinet structure), it is undesirable for an electromagnetic actuation to occur of the bolt 9 to move it back to an unlocked position to allow for it to then become aligned with the aperture 12 for subsequent penetrative engagement and locking therewith. Accordingly the striker 6 includes a guiding or camming surface 15 which upon the movement of the striker to align the aperture 12 with the bolt 9, engages with the distal end of the bolt 9. Further advancement of the striker for alignment of the bolt with the aperture 12, results in a sliding movement of the distal end of the bolt 9 over the camming surface 15. The camming surface 15 is presented at an angle to the direction of travel of the striker 6 during its movement with the cabinet door or drawer (and hence also at an angle to the lateral of the direction of movement of the bolt between the open and closed conditions). The angled surface 15 extends sufficient such that first engagement of the distal end of the bolt 9 with the striker occurs on the angled portion of the striker 15. Further advancement will move the bolt towards the unlocked position and will guide the bolt towards the unlocked position so as to allow it to be retracted sufficient to then penetrate the aperture 12 when the lateral alignment of the striker 6 with the bolt 9 has occurred. The bolt 9 being biased towards the locking position will remain in contact with the camming surface as it progresses therealong and towards alignment with the aperture 12. As soon as the bolt 9 is in alignment with the aperture 12, and under the influence of the bias, the bolt will penetrate into the aperture and thereby lock with the striker. Accordingly in a movement from the unlocked to the locked position there is no requirement for power by the electromagnetics of the present invention.

With reference to FIG. 4 it can be seen that a cabinet lock of the present invention may be part of a system of cabinet locks which may lock more than one drawer or door of a cabinet. As can be seen a plurality of cabinet locks are capable of being utilized in a single or with multiple cabinets where multiple openings are closed by doors or drawers or similar. A single power supply 10 may feed power to all of the cabinet locks which may each be wired in parallel from the single power source 10. It will however be appreciated that actuation of each cabinet lock unit may be required independent of the other and accordingly each cabinet lock unit may be actuated by a designated switch 11. Such a switch 11 upon actuation will only trigger the electromagnetic actuation of the cabinet lock with which it is associated. It will not influence any of the other cabinet locks wired in parallel and as part of the overall system.

The switch 11 may for example be a reed switch which is actuated under the influence of a magnetic field. A person may carry with them a device which includes a magnet such as a permanent magnet which can be waved in proximity to the switch 11 thereby actuating the bolt to move it from the locked position to the unlocked position. For example a parent may carry with them a permanent magnet (for example as a necklace around their neck) to provide for means to have convenient access to the cabinet via particular doors or drawers normally locked by the cabinet locks of the present invention.

Figures 3A, 3B:
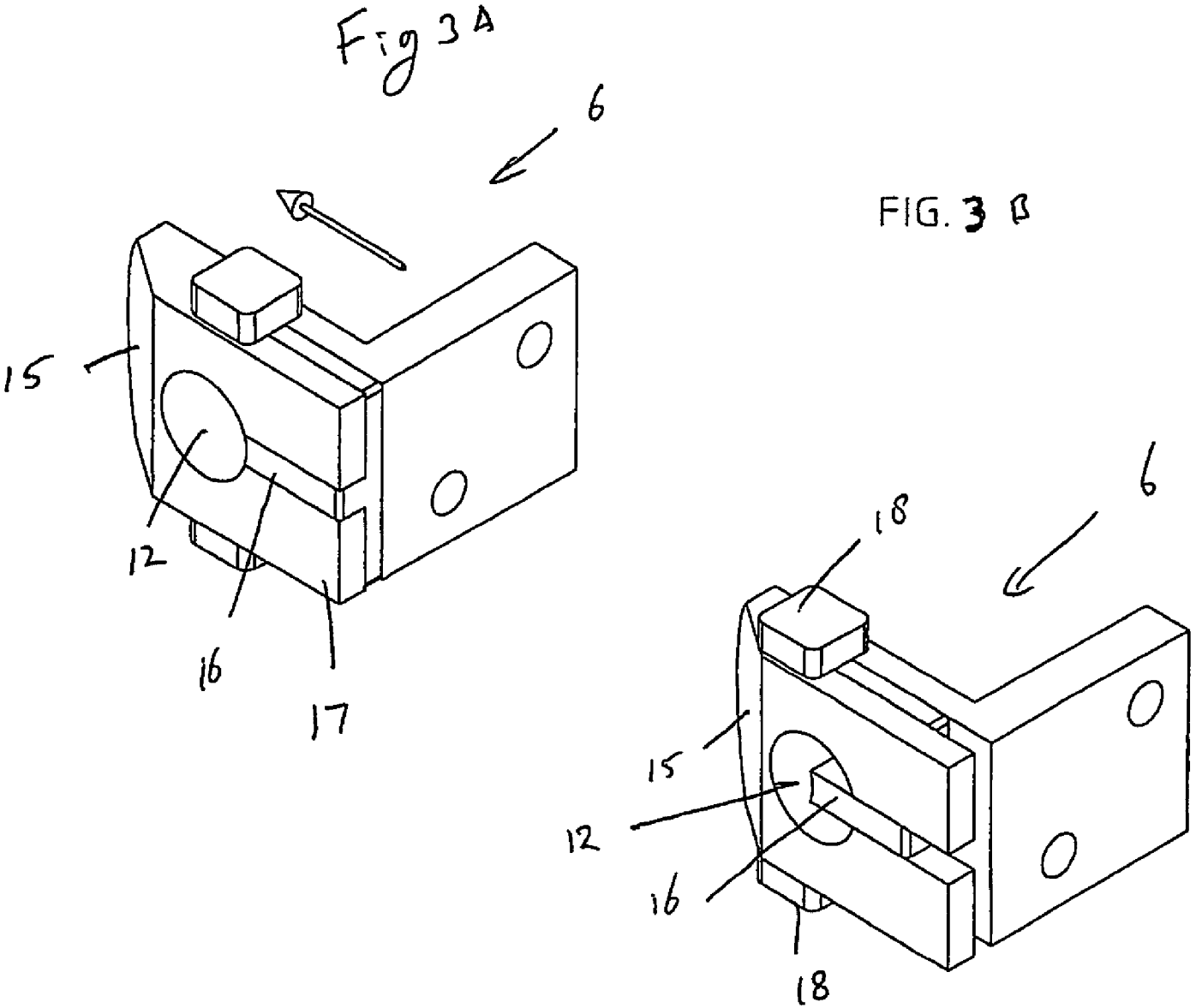
FIG. 3A is a perspective view of the striker and wherein the interference tongue is in a non-interference condition thereby allowing for the bolt of the latch bolt assembly to penetrate the aperture of the striker.
FIG. 3B is a perspective view of FIG. 3A but wherein the interference tongue extends across the aperture of the striker.

As has been mentioned the drawers or doors will normally be in a closed position and in such a closed position it is preferable that they are also in a locked position. As a consequence the bolt 9 is preferably normally biased towards its locked position such that when the striker presents the aperture 12 in alignment therewith the cabinet door or drawer is locked. However in some situations it may be desirable that a particular door or drawer and for example where a series of cabinet locks are provided, that some but not all of the doors or drawers are, when in a closed position, unlocked. It is desirable in such a situation that little or no power consumption occurs. As has been described, movement of the bolt 9 from the locked position to the unlocked position involves the actuation of the electromagnetics thereby displacing the bolt to the unlocked position. A further improvement can be provided to the striker 6 which will allow for a particular door or drawer to be unlocked yet require no or minimal power utilization of the electromagnetics of the latch bolt assembly. With reference to FIGS. 3A and 3B, there is shown a tongue 16 which is moveably disposed from the fixed portion 17 of the striker 6. In particular it is moveably disposed relative to the aperture 12. The tongue 16 can move from a position where it provides no interference to the movement of the bolt 9 into penetrative engagement with the aperture 12 (shown in FIG. 3A) to a position where it does present interference to the movement of the bolt 9 into the aperture 12 (FIG. 3B). In the position of interference the tongue 16 prevents the bolt 9 from moving into the aperture 12 and thereby prevents the bolt 9 from assuming a position whereby it engages with the striker 6. This prevents the movement of the striker in a direction lateral to the movement of the bolt 9. When the tongue 16 is in such an interference condition (as shown in FIG. 3B), the door or drawer is removable from its closed position to an open position without needing to actuate the bolt. The bolt 9 becomes ineffective in locking the door or drawer and merely slides over the aperture 12 without penetrating therewith. As seen in FIGS. 3A and 3B, the tongue 16 is disposed from the fixed structure of the striker 6 in a manner slideable therewith. A pair of lugs 18 are associated with the tongue 16 which can be engaged by a finger or finger of a user to manually move the tongue 16 between the interference and non-interference positions. The bolt 9 as a consequence of it being biased towards the locked position will engage with the tongue 16 in the interference position and will be pressed there against but will not penetrate the aperture 12. In such a configuration no power consumption is required to maintain the relationship between the latch bolt and the striker in an unlocked position. In the most preferred form of a cabinet which incorporates a cabinet lock of the present invention the striker 6 is positioned in such a location so that a user can have convenient access to operate the tongue 16 as and when desired.

Alternative configurations of a tongue or means for interference with the presentation of the aperture 12 for penetration by the bolt 9 may include a means to rotate relative to the fixed structure 17 of the striker 6 or the movement of part of the striker 6 which carries the aperture 12 itself. It may be that the portion of the striker 6 which carries the aperture is movable relative to that portion of the striker 6 which is secured to the door or drawer and the aperture 12 itself may for example be moved slightly up or down to thereby prevent it from coming in alignment with the bolt 9.

The invention claimed is:

1. A cabinet lock for selectively locking a cabinet of a kind comprising a compartment structure and a closure movable relative to said compartment structure for selectively closing an opening of said compartment structure, said cabinet lock comprising:

a latch bolt assembly including a mounting and a bolt movably disposed with said mounting between a locking position and an unlocked position, a striker including a coupling region with which said bolt can couple to thereby prevent relative movement between said bolt and said striker in at least one direction lateral to the direction of movement of said bolt between its locking position and said unlocked position, wherein said striker is engagable with one of said compartment structure and closure and said latch bolt assembly is engagable with the other of said compartment structure and closure in a manner to place such in coupling proximity when said closure is in closing relation with said opening of said compartment structure, said latch bolt assembly including a passive biasing means to bias said bolt to said locking position, and said latch bolt assembly including an electromagnetic means actuable to move said bolt from the locking position to the unlocked position against the bias of the biasing means, said striker including an interference means selectively movable to interfere with the movement of said bolt into coupling engagement with said coupling region of said striker to thereby prevent coupling.

2. The cabinet lock as claimed in claim 1 wherein said bolt moves in a linear manner relative to said mounting between its locking position and an unlocked position.

3. The cabinet lock as claimed in claim 1 wherein said striker includes an aperture, said coupling of said bolt and said striker occurring by a penetrative engagement of said bolt with said aperture thereby preventing relative movement between said bolt and said striker in at least one direction lateral to the direction of penetration of said bolt.

4. The cabinet lock as claimed in claim 1 wherein said striker is in use fixed to one of (a) said compartment structure and (b) closure, and said latch bolt assembly is in use fixed with the other of said compartment structure and closure.

5. The cabinet lock as claimed in claim 1 wherein said striker includes a portion fixed to one of said compartment structure and closure and said interference means is in sliding engagement with the portion fixed.

6. The cabinet lock as claimed in claim 1 wherein said interference means is manually movable.

7. The cabinet lock as claimed in claim 3 wherein said interference means is a cover to at least in part extend across the opening of said aperture of said striker to present interference to the movement of said bolt into said aperture.

8. The cabinet lock as claimed in claim 3 wherein said interference means is a tongue which is capable of extending at least in part across said aperture.

9. The cabinet lock as claimed in claim 3 wherein a ramp leads to a plateau surface of said striker at which the opening to said aperture is provided.

10. The cabinet lock as claimed in claim 1 wherein said interference means is a means movable relative to the fixed portion of said striker the interference means itself carrying and/or defining the aperture, the movement of the interference means relative to the apportion fixed of the striker moving the aperture into and out of alignment for penetrative engagement by said bolt.

11. The cabinet lock as claimed in claim 1 wherein means to control actuation of said electromagnetic means is provided, remote from said latch bolt.

12. The cabinet lock as claimed in claim 11 wherein said electromagnet means is controlled for actuation by a remote switch.

13. The cabinet lock as claimed in claim 12 wherein said remote switch controls the delivery of power from said power source to said electromagnetic means.

14. The cabinet lock as claimed in claim 12 wherein said remote switch is hard wired with said electromagnetic means.

15. The cabinet lock as claimed in claim 12 wherein said remote switch is a reed switch actuable by influence of a magnetic field.

16. The cabinet lock as claimed in claim 15 wherein said magnetic field is provided by a key which includes a permanent magnet.

17. The cabinet lock as claimed in claim 1 wherein said striker includes a ramp surface over which said bolt can slide during movement of said closure to a condition closing the opening of said compartment to displace said bolt towards is unlocked position.

18. The cabinet lock as claimed in claim 1 wherein said electromagnetic means is powered from remote power source.

19. The cabinet lock as claimed in claim 1 wherein said electromagnetic means is a solenoid.

20. The cabinet lock as claimed in claim 1 wherein said electromagnetic means includes the bolt which is of a ferrous material and extending into and/or through a coil capable of being powered by said power source.

21. The cabinet lock as claimed in claim 1 wherein said latch bolt assembly including a first electric connection terminal for the engagement of an electric lead for delivery of electromagnetic power to said latch bolt assembly and a second electric connection terminal in electrical connection with said first and capable of receiving an electric lead for the delivery of said power from said latch bolt assembly to another latch bolt assembly.

22. The cabinet lock as claimed in claim 21 wired in parallel with a like cabinet lock from a common power source and wherein each cabinet lock includes its said bolt disposed from said mount in a manner normally biased towards said locking position save for upon the actuation of said electromagnetic means to move said bolt to the unlocked position.

23. The cabinet lock as claimed in claim 22 wherein each said cabinet lock includes its own designated means to actuate its own said electromagnetic means independently of the other cabinet locks.

24. The cabinet which includes a compartment defining structure including an opening closable by a closure means movable relative to said compartment defining structure, said cabinet further including a cabinet lock for selectively locking said closure means and said compartment defining structure when in a condition closing said compartment defining structure, said cabinet lock being as claimed in claim 1.

25. The cabinet as claimed in claim 24 wherein said mounting includes apertures for mechanically fastening said latch bolt to one of said compartment structure and closure.

26. The cabinet as claimed in claim 24 wherein said striker includes apertures for mechanically fastening said latch bolt to the other of said compartment structure and closure.

27. The cabinet as claimed in claim 24 wherein said mounting is in use fixed to said compartment structure.

28. A cabinet lock for selectively locking a cabinet of a kind comprising a compartment structure and a closure movable relative to said compartment structure for selectively closing an opening of said compartment structure, said cabinet lock comprising:

a latch bolt assembly including a mounting and a bolt movably disposed with said mounting between a locking position and an unlocked position, a striker including a coupling region with which said bolt can couple to thereby isolate relative movement between said bolt and said striker in at least one direction lateral to the direction of movement of said bolt between its locking position and said unlocked position, said striker being engagable with one of said compartment structure and closure and said latch bolt assembly being engagable with the other of said compartment structure and closure in a manner to place such in coupling proximity when said closure is in closing relation with said opening of said compartment structure, said bolt being urged to said locking position, and said striker including an interference means movable to interfere with the movement of said bolt into coupling engagement with said coupling region of said striker to thereby prevent coupling, said latch bolt including an electromagnetic means actuable to displace said bolt from said unlocked position to said locking position, said electromagnetic means being controlled for actuation by a remote switch, said remote switch being a reed switch actuable by influence of a magnetic field.

29. The cabinet lock as claimed in claim 28, wherein said magnetic field is provided by a key which includes a permanent magnet.

30. A cabinet which includes a compartment defining structure including an opening closable by a closure means movable relative to said compartment structure, said cabinet further including a cabinet lock for selectively locking said closure means and said compartment defining structure when in a condition closing said compartment defining structure, said cabinet lock comprising:

a latch bolt assembly including a mounting and a bolt movably disposed with said mounting between a locking position and an unlocked position, a striker including a coupling region with which said bolt can couple to thereby prevent relative movement between said bolt and said striker in at least one direction lateral to the direction of movement of said bolt between its locking position and said unlocked position, said striker is fixed to one of said compartment structure and closure and said latch bolt assembly is fixed to the other of said compartment structure and closure in a manner to place such in coupling proximity when said closure is in closing relation with said opening of said compartment structure, said latch bolt assembly including a passive biasing means to bias said bolt to said locking position, and said latch bolt assembly including an electromagnetic means actuable to move said bolt from the locking position to the unlocked position against the bias of the biasing means, said striker including an interference means selectively movable to interfere with the movement of said bolt into coupling engagement with said coupling region of said striker to thereby prevent coupling.

31. The cabinet as claimed in claim 30 wherein said cabinet includes a plurality of openings closable by independently movable closure means, each closure means having in association a said cabinet lock.

32. The cabinet as claimed in claim 30 wherein each said cabinet lock includes it own designated means to actuate said electromagnetic means and independent of the others.

33. The cabinet as claimed in claim 32 wherein said means to actuate is a switch.

34. The cabinet as claimed in claim 33 wherein said latch bolt and striker are positioned internal of the compartment structure and said switch is actuable from external of the compartment structure.

35. The cabinet as claimed in claim 33 wherein the switch is a magnetically actuable switch.

36. The cabinet as claimed in claim 35 wherein said magnetically actuable switch is placed external of said compartment structure.

37. The cabinet as claimed in claim 35 wherein said magnetically actuable switch is positioned internal of the compartment structure but is positioned to be influenced by a magnetic field the source of which is placed external of the compartment structure.

38. The cabinet as claimed in claim 32 wherein each said electromagnetic means is powered from one power source.

39. A cabinet which includes a compartment defining structure including an opening closable by a closure means movable relative to said compartment structure, said cabinet further including a cabinet lock for selectively locking said closure means and said compartment defining structure when in a condition closing said compartment defining structure, said cabinet lock comprising:

a latch bolt assembly including a mounting and a bolt movably disposed with said mounting between a locking position and an unlocked position, a striker including a coupling region with which said bolt can couple to thereby isolate relative movement between said bolt and said striker in at least one direction lateral to the direction of movement of said bolt between its locking position and said unlocked position, said striker being fixed to one of said compartment structure and closure and said latch bolt assembly being fixed to the other of said compartment structure and closure in a manner to place such in coupling proximity when said closure is in closing relation with said opening of said compartment structure, said bolt being urged to said locking position, and said striker including an interference means movable to interfere with the movement of said bolt into coupling engagement with said coupling region of said striker to thereby prevent coupling, each said cabinet lock including its own designated means to actuate an electromagnetic means of said mounting to move said bolt to the unlocked position, said means to actuate being a switch, the switch being a magnetically actuable switch.

40. The cabinet as claimed in claim 39, wherein said reed switch is placed external of said compartment structure.

41. The cabinet as claimed in claim 39, wherein said reed switch is positioned internal of the compartment structure but is positioned to be influenced by a magnetic field the source of which is placed external of the compartment structure.

* * * * *